United States Patent [19]

Tanaka et al.

[11] Patent Number: 4,968,528

[45] Date of Patent: Nov. 6, 1990

[54] PROCESS FOR PREPARING MAGNETIC RECORDING MEDIUM

[75] Inventors: Yasunori Tanaka; Yasuhito Hiraki, both of Kanagawa, Japan

[73] Assignee: Fuji Photo Film Co., Ltd., Kanagawa, Japan

[21] Appl. No.: 928,685

[22] Filed: Nov. 7, 1986

Related U.S. Application Data

[63] Continuation of Ser. No. 807,008, Dec. 9, 1985, abandoned.

[30] Foreign Application Priority Data

Dec. 11, 1984 [JP] Japan ..... 59-259941

[51] Int. Cl.[5] ..... B05D 5/12

[52] U.S. Cl. ..... 427/131; 427/128; 427/129

[58] Field of Search ..... 427/127–132, 427/48; 428/900, 694

[56] References Cited

U.S. PATENT DOCUMENTS

| | | | |
|---|---|---|---|
| 2,975,754 | 3/1961 | Wright | 118/407 |
| 3,508,947 | 4/1970 | Hughes | 117/34 |
| 4,340,621 | 7/1982 | Matsumiya et al. | 427/322 X |

*Primary Examiner*—Bernard Pianalto

*Attorney, Agent, or Firm*—Sughrue, Mion, Zinn, Macpeak & Seas

[57] ABSTRACT

A process for preparing a magnetic recording medium utilizing an improved coating method. This coating method includes steps of coating a solvent of the same composition as that used in preparation of a magnetic coating solution or one compatible therewith on a continuously running non-magnetic support to prepare a precoat layer of the solvent, and then coating the magnetic recording solution on the precoat layer while the precoat layer is wet. This improved coating method prevents air from being entrained in the magnetic recording solution and thus permits to produce a very thin magnetic recording layer to be formed on the support with high efficiency.

11 Claims, 1 Drawing Sheet

PROCESS FOR PREPARING MAGNETIC RECORDING MEDIUM

This is a continuation of application Ser. No. 807,008, filed Dec. 9, 1985.

BACKGROUND OF THE INVENTION

The present invention relates to a process for preparing a magnetic recording medium. More particularly, it is concerned with an improved coating method whereby a magnetic coating solution can be coated at high speed and in a uniform thin layer on a non-magnetic support to prepare a magnetic recording medium.

In preparing a coating-type magnetic recording medium, conventionally, a magnetic layer has been provided by an extruder coating method. In accordance with this method, as illustrated in FIG. 1, a non-magnetic flexible support 3 continuously running along a back edge 1 and a doctor edge 2 is coated with a magnetic coating solution 5 by continuously extruding the solution 5 through a top portion of a slot 4 defined between the edges 1 and 2. Various improvements of this method have been proposed, for example, in Japanese Patent Application No. 159899/80 and Japanese Published Unexamined Patent Applications Nos. 10912/83 and 11476/83.

In the conventional coating method as described above, however, the minimum coating thickness in which a magnetic coating solution can be coated on a support is (calculated as a dry film thickness) about 1 micron or more even at a coating speed of not more than 100 m/min because the surface to be coated of the support as introduced in the coating machine is in a dry state. Furthermore, as the coating speed (running speed of the support) is increased, the coating thickness is inevitably increased, and at the same time, more air is entrained between the surface of the support and the coating solution during the coating process, resulting in the formation of air bubbles and thus a reduction of the uniformity of the coated film.

Accordingly, in the extrusion coating method, it is necessary to evacuate an air layer on the surface of the support. The degree of this evacuation depends on the pressure exerted by the coating solution generated by impact of the coating solution onto the support. Since, however, as the coating speed is increased, the pressure of the entrained air is increased, it becomes impossible to evacuate the air layer unless the pressure of the coating solution is higher. In order to increase the pressure of the coating solution, it is necessary to increase the flow rate of the coating solution under given coating conditions. This leads to an increase in the coating thickness. In the extrusion coating method, therefore, there is a contradictory relation between high-speed coating and thinness of the coating.

In the case of a magnetic tape for high density recording using finely divided magnetic particles having a high cohesive power and in which the viscosity of the coating solution is high and a very thin magnetic coating is needed, productivity is reduced and it becomes impossible to satisfy the above requirements under any set of conditions.

SUMMARY OF THE INVENTION

An object of the present invention is to provide a coating method for the preparation of a magnetic recording medium which overcomes the above defects of the conventional coating method and permits the production of a magnetic thin coating of good quality with high efficiency.

Another object of the present invention is to provide a coating method for preparing a magnetic recording medium whereby a uniform thin coating can be formed at high speeds.

Still another object of the present invention is to provide a coating method for preparing a magnetic recording medium whereby a magnetic coating solution of high viscosity can be coated in a very thin layer at high speeds.

It has been found that the above objects can be attained by coating a solvent having the same composition as that used in the preparation of the magnetic coating solution or one which is compatible therewith, and then coating the magnetic coating solution while the surface of the support is wet with the solvent.

The present invention further provides a process for preparing a magnetic recording medium by coating a magnetic coating solution on a continuously running nonmagnetic support through a top portion of a slot, which is characterized in that a solvent having the same composition as that used in preparation of the magnetic coating solution or one which is compatible therewith is coated on the support, and then the magnetic coating solution is coated on the solvent-coated surface of the support while it is wet.

DESCRIPTION OF THE PREFERRED EMBODIMENTS

Figure 1:
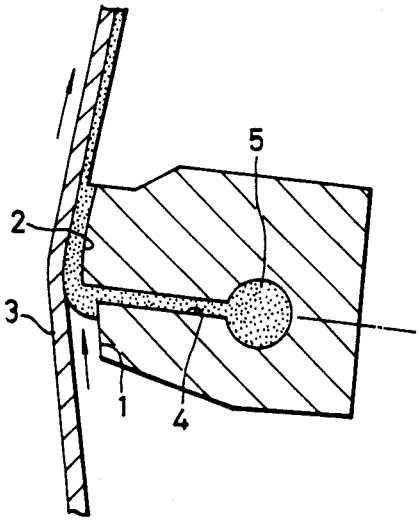
FIG. 1 PRIOR ART
FIG. 1 is an enlarged cross-sectional view showing coating conditions according to the conventional method.
Figure 2:
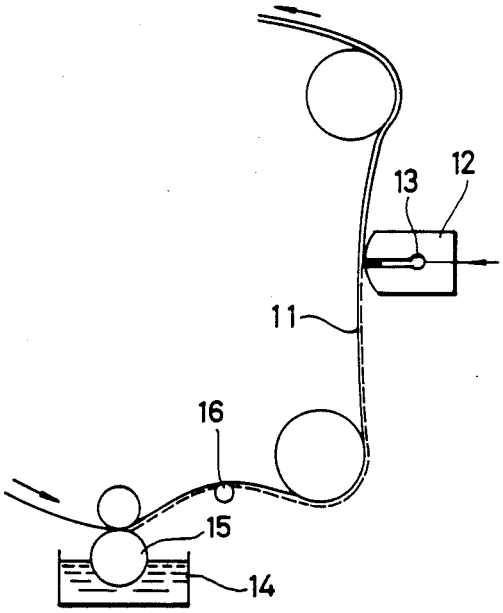
FIG. 2 is a schematic diagram illustrating a coating method of the present invention.

Referring to FIG. 2, there is shown a schematic diagram of an apparatus for practicing the coating method according to the present invention. In coating a magnetic coating solution 13 on a non-magnetic flexible support 11, such as one made of polyethylene terephthalate (PET), while the support 11 is continuously running, a solvent 14 having the same composition as that of the solvent used in preparing the magnetic coating solution 13 or one compatible therewith is precoated on the support 11 by means of a solvent coater 15, and then the magnetic coating solution 13 is coated on the support 11 while it is wet with the solvent 14. Reference numeral 16 indicates a roll controlling the amount of the solvent being coated. Although a roll coater is used in coating the solvent in the embodiment shown in FIG. 2, the present invention is not limited thereto and other coating techniques can be employed.

If a solvent as defined above is previously coated on the support, an air layer is replaced with coating solution on the solvent coating or precoat layer. At this time, the wettability between the precoat layer and the magnetic coating solution is very good, and the precoat layer moves toward the back edge of the coater. Therefore, it is possible to prevent air from being entrained in the magnetic coating solution layer. Even in high-speed coating, it is not necessary to increase the amount of the magnetic coating solution, and air can be prevented from entering the magnetic coating solution layer. Accordingly, thin-layer coating can be accomplished at high speed.

Figure 3A:
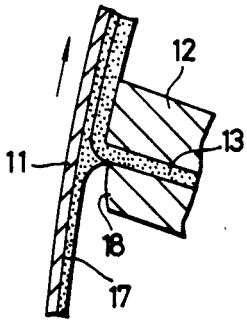
FIGS. 3A to 3C are enlarged cross-sectional views showing coating conditions according to each of three embodiments of the present invention.
Figure 3B:
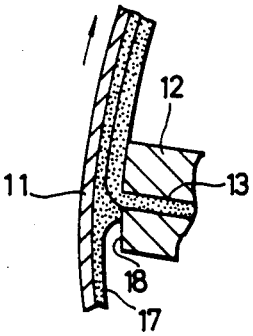
Figure 3C:
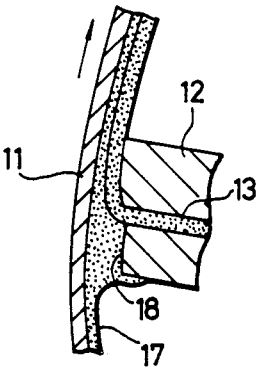

FIGS. 3A to 3C are enlarged cross-sectional views illustrating a top portion of a slot used in the coating method of the present invention. FIG. 3A shows an embodiment in which a magnetic coating solution 13 is coated through a top portion of a slot of a coater 12, wherein a solvent precoat layer 17 has been provided on a support 11. In this embodiment, the precoat layer 17 covers the back of the coating solution, thereby isolating the coating solution from air. In the embodiment of FIG. 3B, the precoat layer 17 further covers the back edge 18 of the coater, and the coating solution is completely isolated from air. In the embodiment of FIG. 3C, the precoat layer 17 further covers the back side of the coater.

The precoat layer 17 passes through a coating zone in the form of a uniform film, remaining attached to the surface of the support. Since, however, the interface between the precoat layer and the magnetic coating solution is deformed as described above, the air layer cannot enter the magnetic coating solution, or it can enter only with difficulty.

In accordance with the present invention, prevention of air from entering the magnetic coating solution can be achieved using smaller amounts of coating solution than with the conventional coating method. Moreover it has been found that the solvent of the precoat layer is uniformly removed through the magnetic layer during the step in which the layer of the magnetic coating solution is dried, and that the solvent does not exert any adverse influences on the adhesion between the magnetic layer and the support or on the quality of the magnetic layer.

Non-magnetic supports which can be used include flexible plastic films such as polyesters (e.g., polyethylene terephthalate (PET) and polyethylene naphthalate), polyolefins (e.g., polypropylene), and cellulose derivatives (e.g., cellulose triacetate and cellulose diacetate).

As finely powdered ferromagnetic substances used in the magnetic layer of the present invention, various known ferromagnetic substances can be used, including $\gamma$ - $Fe_2O_3$, Co-containing $\gamma$ - $Fe_2O_3$, $Fe_3O_4$, Co-containing $Fe_3O_4$, $CrO_2$, Co-Ni-Fe alloy, and Co-Ni-P alloy.

This finely powdered ferromagnetic substance is dispersed in an organic solvent along with a binder and other additives to prepare a magnetic coating solution. These binders, solvents and additives, and a method of preparing a magnetic recording medium using them are described in, for example, Japanese Patent Publication No. 26890/81.

The magnetic coating solution is coated with an extrusion coating apparatus. Apparatuses described in, for example, Japanese Patent Application No. 159899/80, Japanese Unexamined Published Patent Applications Nos. 10912/83 and 111476/83, can be used.

In the preparation of the precoat layer according to the present invention, any solvent can be used as long as it has good wettability with the support and good compatibility with the solvent used in preparation of the magnetic coating solution. Solvents having the same composition as or a similar composition to that of the solvent for use in preparation of the coating solution are preferably used.

Although the type of the solvent varies with that used in preparation of the magnetic coating solution, in general, toluene, methyl ethyl ketone and the like can be used alone or in combination with each other. In addition to using a solvent alone, a solution containing a binder can be used. The viscosity of the coating solution used for forming the precoat layer is preferably low, not more than 50 c.p., preferably not more than 20 c.p., and more preferably not more than 5 c.p.

The thickness of the precoat layer is controlled within a range in which the effect of the precoat layer is exhibited sufficiently and so that it does not exert adverse influences on the quality of the magnetic layer. In general, the thickness of the precoat layer is 0.5 to 20 microns, and preferably 1 to 10 microns.

The present invention will be described in greater detail with reference to the following examples.

EXAMPLE 1

A 14-micron thick PET film base was coated with a magnetic layer in a magnetic layer coating zone after the film base had been coated with a precoat layer.

For comparison, the same procedure was repeated wherein the precoat layer was not provided on the film base.

The thickness in which the magnetic layer could be coated was examined for both the cases.

The compositions of the magnetic coating solution and of the precoat layer are shown below:

| Coating Solution for Preparation of Magnetic Layer | Amount (parts) |
|---|---|
| Co-containing ferromagnetic iron oxide ($S_{BET}$ 35 $m^2/g$) | 100 |
| Nitrocellulose | 10 |
| Polyurethane resin (Nippollan 2304 produced by Nippon Polyurethane Co., Ltd.) | 8 |
| Polyisocyanate | 8 |
| $Cr_2O_3$ | 2 |
| Carbon black (average particle diameter: 20 microns) | 2 |
| Stearic acid | 1 |
| Butyl stearate | 1 |
| Methyl ethyl ketone | 300 |
| Coating Solution for Preparation of Precoat Layer | |
| Methyl ethyl ketone | 100 |
| Toluene | 100 |
| Nitrocellulose | 5 |
| Coating conditions were as follows: | |
| Coating speed: 100 m/min, 200 mm/min | |
| Web width: 500 mm | |

Tension in the coating zone: 15 kg/m

Thickness of the magnetic layer (dry film thickness): 0.5, 1.0, and 2.0 microns

Thickness of the precoat layer (liquid film thickness): 1, 2, 5, and 0 microns

The results are shown in the table below.

TABLE

| | Thickness of Precoat Layer (Liquid) | | | | | | Precoat Layer | |
|---|---|---|---|---|---|---|---|---|
| | 1 micron | | 2 microns | | 5 microns | | none | |
| Coating Speed (m/min) | 100 | 200 | 100 | 200 | 100 | 200 | 100 | 200 |
| Magnetic Layer | | | | | | | | |
| 0.5 micron | 0 | 0 | 0 | 0 | 0 | 0 | X | X |
| 1.0 micron | 0 | 0 | 0 | 0 | 0 | 0 | 0 | X |
| 2.0 microns | 0 | 0 | 0 | 0 | 0 | 0 | 0 | 0 |

In the table, 0 indicates that coating is possible and X indicates that coating is impossible.

It can be seen from the results in the Table that if the thickness of the magnetic layer is not more than 1 micron, the effect of the liquid precoat layer is markedly exhibited.

When the magnetic layer was coated after the precoat layer was once dried, the results were the same as in the case that the precoat layer was not provided.

EXAMPLE 2

The procedure of Example 1 was repeated wherein, for the preparation of the precoat layer, the following solutions were used:

(1) methyl ethyl ketone alone, (2) toluene alone, (3) mixture of 100 parts of methyl ethyl ketone and 100 parts of toluene, and (4) mixture of 100 parts of methyl ethyl ketone and 10 parts of methyl cellulose.

In all cases, the same results as in Example 1 were obtained.

The coating method of the present invention yields various advantages. For example, a magnetic coating solution can be coated in a thin film form at high speed. Even when the viscosity of the magnetic coating solution is high, a thin magnetic coating can be formed with high efficiency.

We claim:

1. In coating a thin magnetic film on a non-magnetic flexible support, including the steps of precoating the non-magnetic flexible support by providing a first solvent on said support, and coating a magnetic coating solution on said support over said first solvent, said first solvent being the same as or compatible with a second solvent used to prepare said solution, a process of preventing entrapment of air between the non-magnetic flexible support and the thin magnetic film, said process comprising the steps of performing said precoating step continuously to form a precoat layer, and then performing said coating step continuously and concurrently with said precoating step.

2. The process as claimed in claim 1, wherein said magnetic coating solution is coated under the condition that a back of said magnetic coating solution is isolated from the ambient air by the action of the solvent previously coated.

3. The process as claimed in claim 1, wherein said magnetic coating solution has good wettability for said substrate.

4. The process as claimed in claim 1, wherein said magnetic coating solution is selected from the group consisting of toluene and methyl ethyl ketone, alone and in combination with one another.

5. The process as claimed in claim 4, wherein said magnetic coating solution further contains a binder.

6. The process as claimed in claim 1, wherein the viscosity of said precoat layer is not more than 50 c.p.

7. The process as claimed in claim 1, wherein the viscosity of said precoat layer is not more than 20 c.p.

8. The process as claimed in claim 1, wherein the viscosity of said precoat layer is not more than 5 c.p.

9. The process as claimed in claim 1, wherein the thickness of said precoat layer is in a range of 0.5 to 20 microns.

10. The process as claimed in claim 1, wherein the thickness of said precoat layer is in a range of 0.5 to 10 microns.

11. A process as claimed in claim 1, wherein a layer of from 1 to 5 microns is provided in said precoating step, and a magnetic layer of 0.5 to 2.0 microns is provided in said coating step.

* * * * *